US006600302B2

(12) United States Patent
Ghozeil et al.

(10) Patent No.: US 6,600,302 B2
(45) Date of Patent: Jul. 29, 2003

(54) VOLTAGE STABILIZATION CIRCUIT

(75) Inventors: Adam L Ghozeil, Corvallis, OR (US); Jeffery S Beck, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/999,887

(22) Filed: Oct. 31, 2001

(65) Prior Publication Data

US 2003/0080720 A1 May 1, 2003

(51) Int. Cl.[7] ..... G05F 3/30; G05F 3/20
(52) U.S. Cl. ..... 323/313; 323/314; 323/907
(58) Field of Search ..... 323/313, 312, 323/311, 314, 315, 316, 907; 327/541, 539, 538, 537

(56) References Cited

U.S. PATENT DOCUMENTS

| | | | | | |
|---|---|---|---|---|---|
| 4,588,941 | A | * | 5/1986 | Kerth et al. | 323/314 |
| 4,882,548 | A | * | 11/1989 | Marrah et al. | 330/288 |
| 5,038,053 | A | * | 8/1991 | Djenguerian et al. | 307/310 |
| 5,570,008 | A | * | 10/1996 | Goetz | 323/315 |
| 6,111,396 | A | * | 8/2000 | Lin et al. | 323/313 |

* cited by examiner

*Primary Examiner*—Rajnikant B. Patel
(74) *Attorney, Agent, or Firm*—Lee & Hayes, PLLC

(57) ABSTRACT

A voltage stabilization circuit includes a band gap reference circuit to generate a stable output voltage that is temperature-independent, and a folded cascode feedback circuit to generate a feedback potential that is applied to stabilize the band gap reference circuit. The folded cascode feedback circuit is implemented with current mirror circuits.

28 Claims, 6 Drawing Sheets

VOLTAGE STABILIZATION CIRCUIT

TECHNICAL FIELD

This invention relates to an electrical circuit and, in particular, to systems and methods for a voltage stabilization circuit.

BACKGROUND

A band gap reference circuit is typically utilized to generate an output voltage that can be applied as a reference voltage to another circuit. The temperature of an operating environment affects properties of circuit components, and variations in temperature tend to result in output voltage variations. Typically, a band gap reference circuit in a particular operating environment is designed to generate an acceptable voltage output range that accounts for temperature variability.

Additionally, a supply voltage can oscillate and introduce unwanted noise when the power source is not stable, or when the supply voltage is subjected to varying loads. Subjecting a band gap reference circuit to unwanted noise can also vary the output voltage, and subsequently affect the circuit to which the reference voltage is applied.

The following description discusses systems and methods for generating a reference voltage that is stable and temperature-independent.

SUMMARY

A voltage stabilization circuit includes a band gap reference circuit to generate a stable output voltage that is temperature-independent, and a folded cascode feedback circuit to generate a feedback potential that is applied to stabilize the band gap reference circuit. The folded cascode feedback circuit is implemented with current mirror circuits.

BRIEF DESCRIPTION OF THE DRAWINGS

The same numbers are used throughout the drawings to reference like features and components.

DETAILED DESCRIPTION

Introduction

The following describes systems and methods for a band gap reference circuit with a folded cascode feedback that generates a stable and temperature-independent reference voltage, and improves power supply rejection without limiting supply voltage headroom.

In the exemplary embodiments, specific electrical circuits and methods are illustrated and described. However, the specific examples are not meant to limit the scope of the claims or the description, but are meant to provide a specific understanding of the described implementations.

Exemplary Circuits

Figure 1:
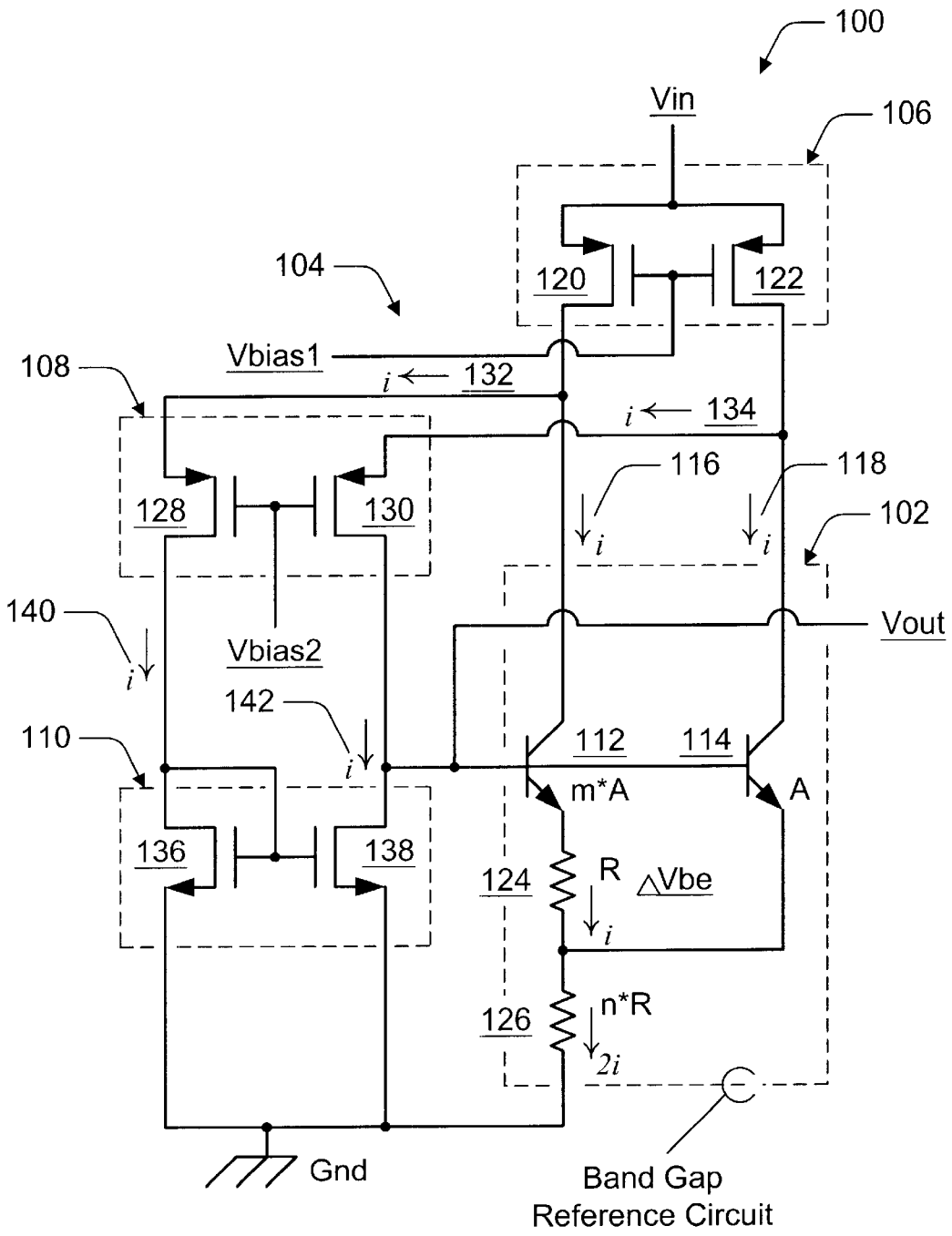
FIG. 1 is a circuit diagram that illustrates a band gap reference circuit with a folded cascode feedback circuit in one embodiment of the present invention.

FIG. 1 illustrates an exemplary electrical circuit 100 that includes a band gap reference circuit 102 with a folded cascode feedback circuit 104 that provides feedback for the band gap reference circuit 102. The folded cascode feedback circuit 104 includes current mirror circuits 106, 108, and 110. The band gap reference circuit 102 includes a first bipolar junction transistor 112 and a second bipolar junction transistor 114. Each of the transistors 112 and 114 have a current 116 and 118, respectively, input to the collector from the current mirror circuit 106.

Current mirror circuit 106 includes a first MOSFET (metal oxide semiconductor field-effect transistor) 120 and a second MOSFET 122. Each of the field-effect transistors 120 and 122 have an input voltage (Vin) applied to the source, and a bias voltage (Vbias1) applied to the gate. In this example, the field-effect transistors of the current mirror circuits have a one volt threshold voltage, and the input voltage Vin can operate the circuits at 4.5 volts.

A current 116 output from field-effect transistor 120 is input to transistor 112 of the band gap reference circuit 102. Similarly, current 118 output from field-effect transistor 122 is input to transistor 114 of the band gap reference circuit 102. Ideally, current 116 output from field-effect transistor 120 and current 118 output from field-effect transistor 122 have the same ampere value.

Bipolar junction transistor 114 of the band gap reference circuit 102 has a base emitter area "A", and bipolar junction transistor 112 has a base emitter area "m*A", where "m" is a constant eight (8) for this example. The ratio between the two base emitter areas results in a voltage difference (□Vbe) between the base emitter voltage of transistor 112 and the base emitter voltage of transistor 114. The band gap reference circuit 102 includes a first resistor 124 and a second resistor 126. The voltage difference □Vbe is applied across resistor 124 and is proportional to the ratio between the two base emitter areas of the two transistors and the operating environment temperature.

A current "i" is generated when the voltage difference □Vbe is applied across resistor 124. Resistor 124 has a value of "R" ohms, and resistor 126 has a value of "n*R" ohms, where "n" is a constant five (5) for this example. In this example, resistor 124 is 1.6K ohms and resistor 126 is 8K ohms. The current through resistor 126 is "2i", and with the ratio between the two resistor values, the voltage across resistor 126 is proportional to both the constant "n" and to the voltage difference □Vbe. Effectively, the resistance is null and the result is a voltage gain across resistor 126 that is proportional to the operating environment temperature.

The base emitter voltage of each transistor 112 and 114 is complimentary to temperature. A resultant temperature-stable voltage (Vout) is achieved when the base emitter voltage of transistor 114 is added to the temperature proportional voltage across resistor 124. The resultant output voltage Vout is seen at the base of both transistors 112 and 114, and is independent of temperature variations in the operating environment and/or variations of Vin.

The current mirror circuits 106, 108, and 110 are configured to form the folded cascode feedback circuit 104. Current mirror circuit 108 includes a first MOSFET 128 and a second MOSFET 130. Each of the field-effect transistors 128 and 130 have an input voltage (Vin) applied to the source, and a bias voltage (Vbias2) applied to the gate. A current 132 from transistor 120 of current mirror 106 is input to field-effect transistor 128. Similarly, a current 134 from transistor 122 of current mirror 106 is input to field-effect transistor 130.

Current mirror circuit 110 of the folded cascode feedback circuit 104 includes a first MOSFET 136 and a second MOSFET 138. A current 140 output from field-effect transistor 128 of current mirror circuit 108 is input to the drain of field-effect transistor 136 and to the gates of both transistors 136 and 138. The gates of transistors 136 and 138 are driven by the drain of transistor 136. A current 142 output from field-effect transistor 130 of current mirror circuit 108 is input to the drain of field-effect transistor 138.

The bias voltages Vbias1 and Vbias2 are generated by an external bias generator circuit. The voltage Vbias1 is applied at current mirror circuit 106 such that each field-effect transistor 120 and 122 generate "2i" currents 116 plus 132, and currents 118 plus 134. The voltage Vbias2 is applied at current mirror circuit 108 such that each field-effect transistor 128 and 130 generate "i" currents 140 and 142.

The feedback from the folded cascode feedback circuit 104 drives the base voltage of the two bipolar junction transistors 112 and 114 of the band gap reference circuit 102 to 1.2 volts. The feedback also stabilizes the base voltage of the two transistors 112 and 114 so that they sink the same amount of current 116 and 118, respectively. The resultant output voltage Vout is seen at the base of both transistors 112 and 114, and is independent of temperature variations in the operating environment and/or variations of Vin. The output voltage Vout does not vary as a function of temperature and is stable over a broad range of temperatures, such as from zero (0) to one-hundred (100) degrees C.

The exemplary electrical circuit 100 is compact and stable, and produces a temperature-stable reference voltage (Vout) with good supply rejection using a low input voltage Vin of 4.5 volts with one (1) volt transistors. Those skilled in the art will recognize that exemplary electrical circuit 100 can implemented with lower voltage transistors, and a lower input voltage Vin. For example, exemplary electrical circuit 100 can be implemented in low-voltage bi-CMOS analog circuits. Those skilled in the art will also recognize that all of the component values are exemplary, and that any number and combination of components can be utilized to implement the exemplary electrical circuit 100 and the other exemplary electrical circuits described herein. It is to be appreciated that substitute component configurations should take into account the complimentary aspects of the components, such as resistors 124 and 126 of the band gap reference circuit 102.

Implementing the exemplary electrical circuit 100 with a low supply voltage avoids the need for two-gate processes when combining the exemplary circuit with a low-voltage digital circuit. For example, exemplary electrical circuit 100 can provide a stable and precise 1.2 volt reference voltage for input to an analog-to-digital converter when a precision digital scale is required. The digital range of the analog-to-digital converter will not change as a function of temperature variations in the operating environment and/or variations of the input voltage Vin to electrical circuit 100.

Additional components can be added to the exemplary electrical circuit 100 to modify the output voltage Vout, increase output current drive capability of the band gap reference circuit 102, and/or improve stability of the band gap reference circuit 102 without compromising the temperature-stability of the exemplary circuit.

Figure 2:
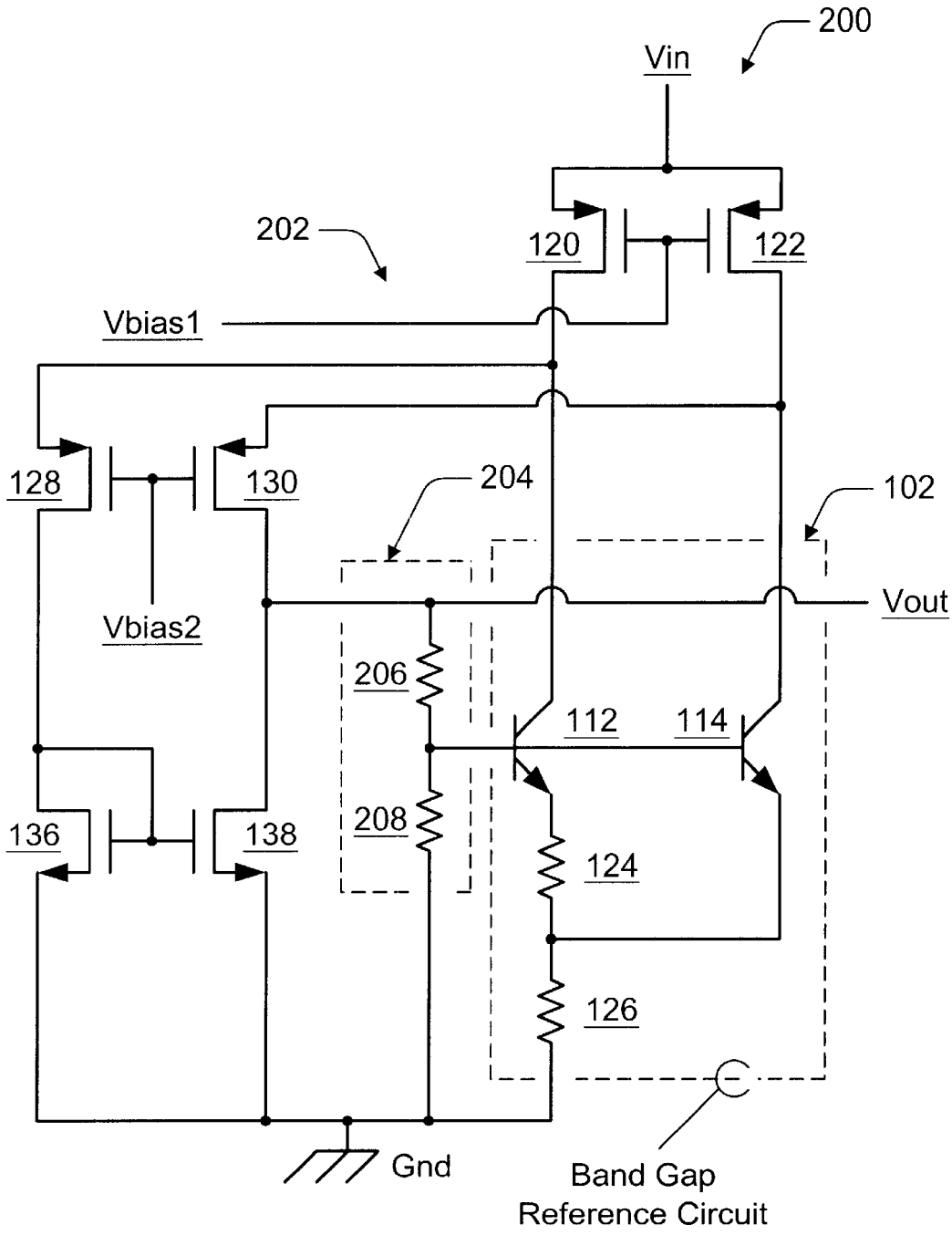
FIG. 2 is a circuit diagram that illustrates the band gap reference circuit with the folded cascode feedback circuit shown in FIG. 2 with a voltage divider to modify the output voltage.

FIG. 2 illustrates an exemplary electrical circuit 200 which includes a folded cascode feedback circuit 202 that provides feedback for the band gap reference circuit 102 (FIG. 1). The folded cascode feedback circuit 202 is the same as the folded cascode feedback circuit 104 (FIG. 1) with the addition of a voltage divider 204 to modify the output voltage Vout. Voltage divider 204 includes a first resistor 206 and a second resistor 208 which have a ratio value between them that is determined independently of resistors 124 and 126 of the band gap reference circuit 102. In this example, resistor 206 is 1.6K ohms and resistor 208 is 6.4K ohms.

Voltage divider 204 can be used to modify the output voltage Vout from 1.2 volts if resistor 206 is zero ohms, to above 1.2 volts for a resistor 206 value above zero ohms. The output voltage can be modified from 1.2 volts up to a voltage that is less than the input voltage Vin, which is 4.5 volts in this example.

Figure 3:
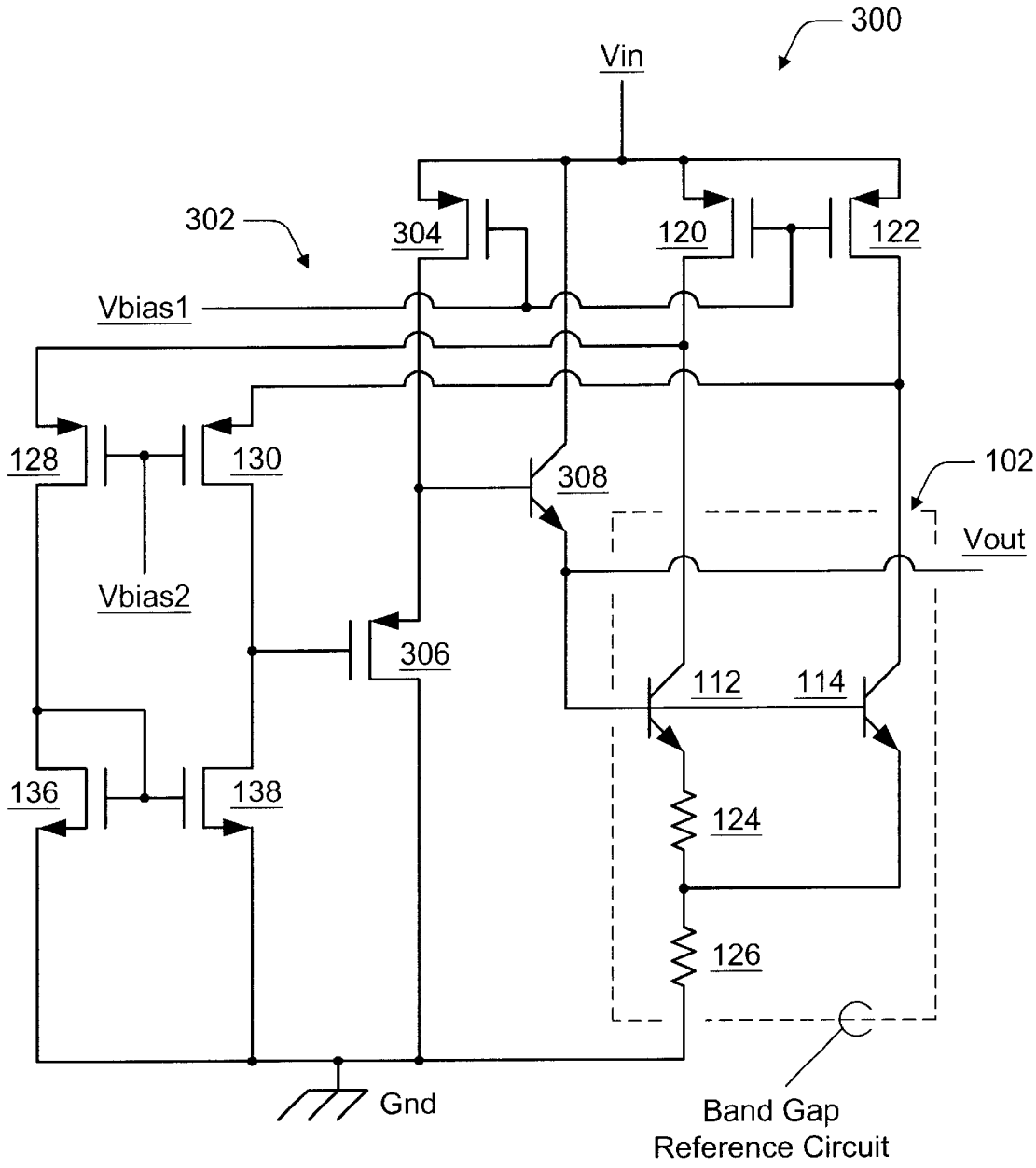
FIG. 3 is a circuit diagram that illustrates the band gap reference circuit with the folded cascode feedback circuit shown in FIG. 2 with components to modify the output drive current.

FIG. 3 illustrates an exemplary electrical circuit 300 which includes a folded cascode feedback circuit 302 that provides feedback for the band gap reference circuit 102 (FIG. 1). The folded cascode feedback circuit 302 is the same as the folded cascode feedback circuit 104 (FIG. 1) with the addition of transistor components that increase the output current drive capability of the band gap reference circuit 102.

The folded cascode feedback circuit 302 includes a MOSFET 304, another MOSFET 306, and a bipolar junction transistor 308. The field-effect transistor 304 has an input voltage (Vin) applied to the source, and a bias voltage (Vbias1) applied to the gate. The field-effect transistor 306, in combination with transistor 308, applies a voltage to the base of each transistor 112 and 114, and increases the output drive current so that the exemplary electrical circuit 300 can drive a larger load on Vout.

Figure 4:
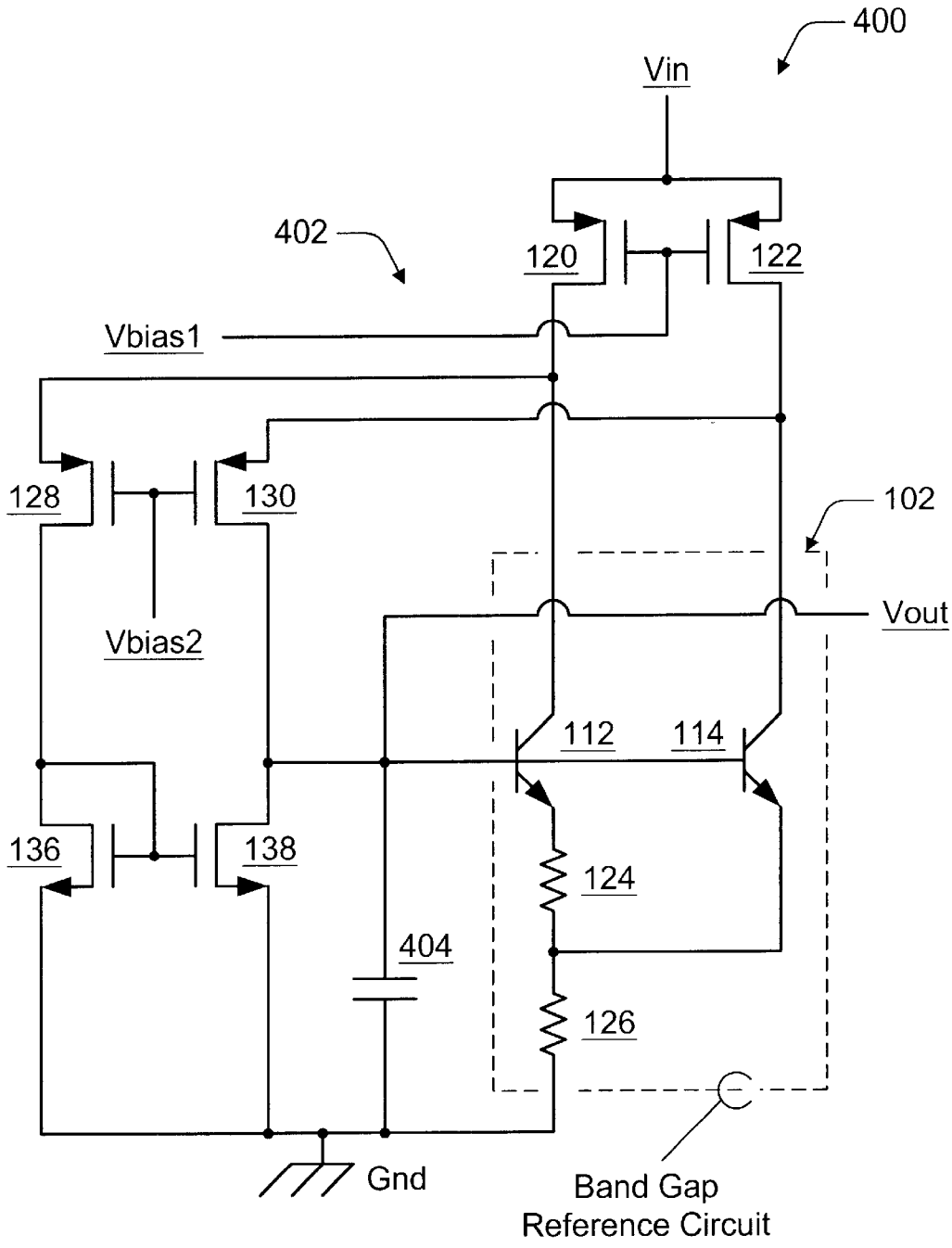
FIG. 4 is a circuit diagram that illustrates the band gap reference circuit with the folded cascode feedback circuit shown in FIG. 2 with a circuit stabilization component.

FIG. 4 illustrates an exemplary electrical circuit 400 which includes a folded cascode feedback circuit 402 that provides feedback for the band gap reference circuit 102

(FIG. 1). The folded cascode feedback circuit 402 is the same as the folded cascode feedback circuit 104 (FIG. 1) with the addition of a capacitor 404 that improves stability of the exemplary electrical circuit 400 by preventing a positive feedback potential from being applied to the band gap reference circuit 102. In this example, capacitor 404 is sized at ten (10) picofarads.

Figure 5:
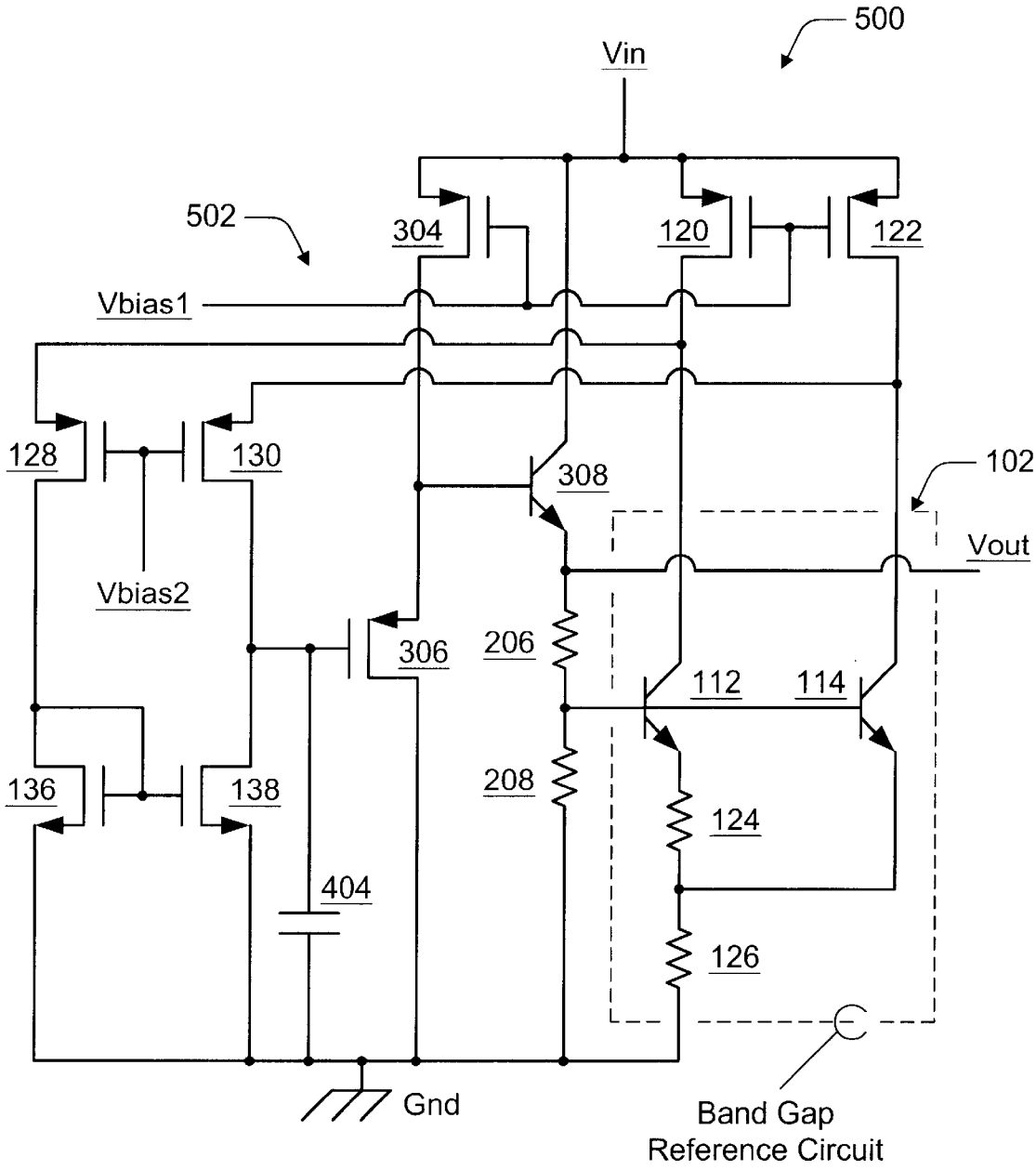
FIG. 5 is a circuit diagram that illustrates the band gap reference circuit with the folded cascode feedback circuit shown in FIG. 2 with the additional circuit components shown in FIGS. 3–5.

FIG. 5 illustrates an exemplary electrical circuit 500 which includes a folded cascode feedback circuit 502 that provides feedback for the band gap reference circuit 102 (FIG. 1). The folded cascode feedback circuit 502 is the same as the folded cascode feedback circuit 104 (FIG. 1) with the addition of the components that can be implemented to modify the output voltage Vout (FIG. 2), increase output current drive capability of the band gap reference circuit (FIG. 3), and improve the stability (FIG. 4) of exemplary circuit 500. FIG. 5 illustrates the circuit configuration for the components of FIGS. 1–4 that can be implemented as an exemplary band gap reference circuit with a folded cascode feedback circuit.

Exemplary electrical circuit 500 is configured to provide an improved power supply rejection over a conventional band gap reference circuit. Variations of the input voltage Vin can cause mismatched currents 116 and 118 (FIG. 1) which disrupts the temperature-stable nature of a band gap reference circuit. The folded cascode feedback circuit 502, which is implemented with current mirror circuits, compensates for variations of the input voltage Vin. Additionally, the folded aspect of feedback circuit 502 compensates for the input voltage variations without requiring a higher input voltage Vin.

Exemplary circuit 500 operates such that if the voltage at the base of transistors 112 and 114 of the band gap reference circuit 102 is too low, then the current through each of the transistors 112 and 114 will not be equivalent. Similarly, if the voltage at the base of the transistors 112 and 114 is too high, the current through each of the two transistors will not be equivalent.

If the current through transistor 114 of the band gap reference circuit 102 is lower than the current through transistor 112, then there will be more current through field-effect transistor 130 than through field-effect transistor 128. The gate voltage of field-effect transistor 306 will increase which in turn increases the base voltage of transistors 112 and 114. This increases the current through transistor 114 to match the current through transistor 112. Conversely, if the current through transistor 114 is higher than the current through transistor 112, then there will be less current through field-effect transistor 130 than through field-effect transistor 128, the gate voltage of field-effect transistor 306 will decrease, the base voltage of transistors 112 and 114 will decrease, and the current through transistor 114 will be decreased to match the current through transistor 112.

The folded cascode feedback circuit 502 is designed to drive the voltage at the base of transistors 112 and 114 to a value that results in matching currents through the two transistors. This generates the temperature-stable output voltage Vout.

Methods for Exemplary Circuits

Figure 6:
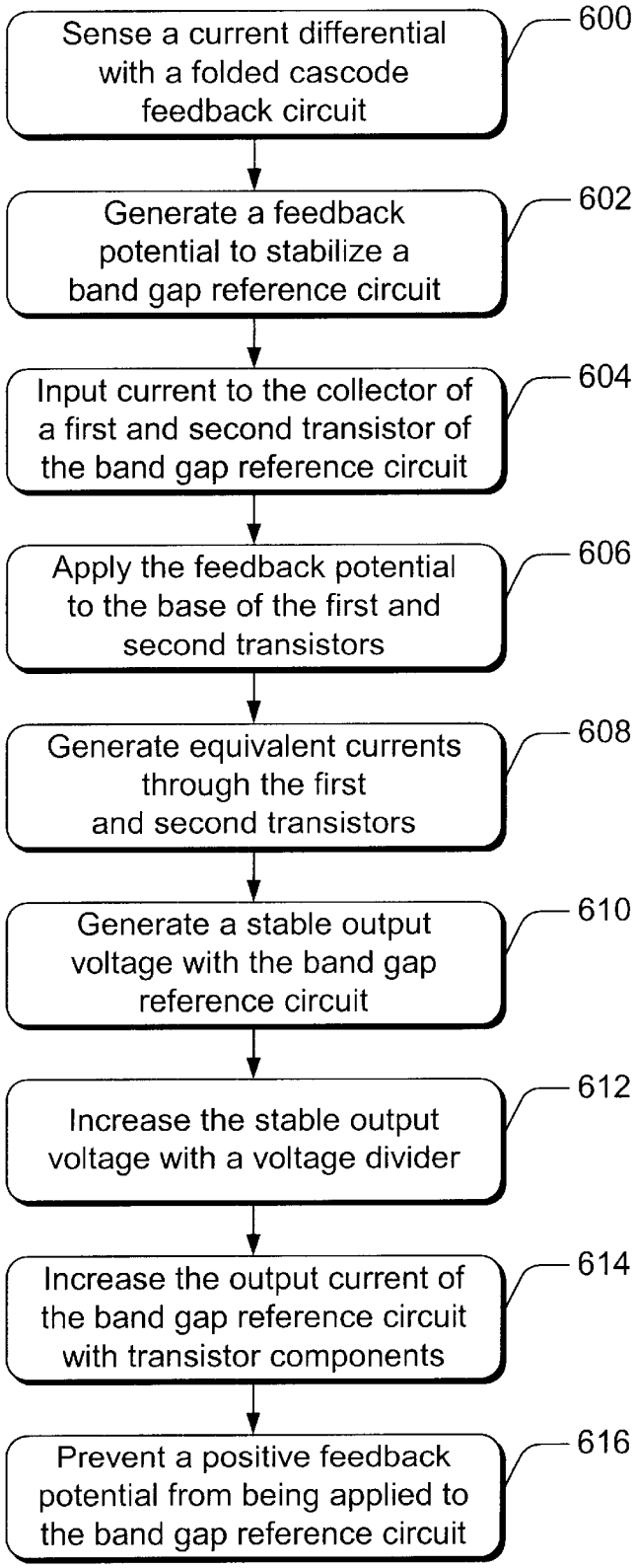
FIG. 6 is a flow diagram that describes a method for a band gap reference circuit with a folded cascode feedback circuit in one embodiment of the present invention.

FIG. 6 illustrates methods for a band gap reference circuit with a folded cascode feedback. The order in which the method is described is not intended to be construed as a limitation.

At block 600, a current differential is sensed with a folded cascode feedback circuit. At block 602, a feedback potential corresponding to the current differential is generated to stabilize a band gap reference circuit. The feedback potential is generated with current mirror circuits of the folded cascode feedback circuit.

At block 604, a current is input to the collector of a first and second transistor of the band gap reference circuit. At block 606, the feedback potential is applied to the base of the first and second transistor of the band gap reference circuit. Applying the feedback potential generates equivalent currents through each of the first and second transistors at block 608. The current through the first transistor is equivalent to the current through the second transistor.

At block 610, a stable output voltage is generated with the band gap reference circuit. At block 612, the stable output voltage is increased with a voltage divider implemented as a component of the folded cascode feedback circuit.

At block 614, an output current of the band gap reference circuit is increased with transistor components that are implemented with the folded cascode feedback circuit. At block 616, a positive feedback potential is prevented from being applied to the first or second transistors of the band gap reference circuit.

Conclusion

The electrical circuits and methods illustrated and described for a band gap reference circuit with a folded cascode feedback generate a stable and temperature-independent reference voltage, and improve power supply rejection without limiting supply voltage headroom. Additionally, the exemplary circuits do not require a startup circuit or other preconditioning circuitry to force component voltages to a useful level.

Although the invention has been described in language specific to structural features and/or methodological steps, it is to be understood that the invention defined in the appended claims is not necessarily limited to the specific features or steps described. Rather, the specific features and steps are disclosed as preferred forms of implementing the claimed invention.

What is claimed is:

1. A voltage stabilization circuit, comprising:

a first circuit configured to generate a stable output voltage that is temperature-independent; and a second circuit implemented with current mirror circuits in a folded cascode configuration, the second circuit configured to generate a feedback potential that is applied to the first circuit to stabilize the first circuit.

2. A voltage stabilization circuit as recited in claim 1, wherein the first circuit is a band gap reference circuit.

3. A voltage stabilization circuit as recited in claim 1, wherein the first circuit is a band gap reference circuit that includes a first transistor and a second transistor, and wherein the feedback potential, when applied to the first circuit, generates a current through the first transistor that is equivalent to a current generated by the feedback potential through the second transistor.

4. A voltage stabilization circuit as recited in claim 1, wherein:

the first circuit is a band gap reference circuit that includes a first bipolar junction transistor and a second bipolar junction transistor;

the feedback potential generated by the second circuit is applied to a base of the first bipolar junction transistor and to a base of the second bipolar junction transistor; and the feedback potential, when applied to the first circuit, generates a current through the first bipolar junction transistor that is equivalent to a current generated by the feedback potential through the second bipolar junction transistor.

5. A voltage stabilization circuit as recited in claim 1, wherein the second circuit is further implemented with a voltage divider configured to increase the stable output voltage of the first circuit.

6. A voltage stabilization circuit as recited in claim 1, wherein the second circuit is further implemented with transistor components configured to increase an output current of the first circuit.

7. A voltage stabilization circuit as recited in claim 1, wherein the second circuit is further implemented with a stabilization component configured to prevent a positive feedback potential from being applied to the first circuit.

8. A voltage stabilization circuit as recited in claim 1, wherein the second circuit is further implemented with a capacitor coupled to the first circuit, the capacitor configured to prevent a positive feedback potential from being applied to the first circuit.

9. A voltage stabilization circuit as recited in claim 1, wherein the second circuit is further implemented with:

a voltage divider configured to increase the stable output voltage of the first circuit;

transistor components configured to increase an output current of the first circuit; and a stabilization component configured to prevent a positive feedback potential from being applied to the first circuit.

10. A voltage stabilization circuit as recited in claim 9, wherein the stabilization component is a capacitor, and wherein the transistor components include a field-effect transistor coupled to a bipolar junction transistor, the field-effect transistor coupled to the current mirror circuits and to the capacitor, and the bipolar junction transistor coupled to the voltage divider.

11. An electrical circuit, comprising:

a band gap reference circuit configured to generate a stable output voltage;

a first current mirror circuit configured to generate current input to the band gap reference circuit;

a second current mirror circuit coupled to the first current mirror circuit; and a third current mirror circuit coupled to the second current mirror circuit, wherein the first current mirror circuit, the second current mirror circuit, and the third current mirror circuit are implemented in a folded cascode configuration to form a folded cascode feedback circuit configured to generate a feedback potential that is applied to the band gap reference circuit.

12. An electrical circuit as recited in claim 11, further comprising at least one other current mirror circuit implemented as a component of the folded cascode feedback circuit.

13. An electrical circuit as recited in claim 11, wherein the band gap reference circuit includes a first transistor and a second transistor, and wherein a current through the first transistor is equivalent to a current through the second transistor when the feedback potential is applied to the first transistor and to the second transistor.

14. An electrical circuit as recited in claim 11, wherein:

the band gap reference circuit includes a first bipolar junction transistor and a second bipolar junction transistor;

the first current mirror circuit includes a first field-effect transistor coupled to the first bipolar junction transistor, and a second field-effect transistor coupled to the second bipolar junction transistor;

a current generated by the first field-effect transistor is input to the first bipolar junction transistor, and a current generated by the second field-effect transistor is input to the second bipolar junction transistor; and the current through the first bipolar junction transistor is equivalent to the current through the second bipolar junction transistor when the feedback potential is applied to the first bipolar junction transistor and to the second bipolar junction transistor.

15. An electrical circuit as recited in claim 11, further comprising a voltage divider configured to increase the stable output voltage of the band gap reference circuit.

16. An electrical circuit as recited in claim 11, further comprising a voltage divider coupled to the folded cascode feedback circuit and to the band gap reference circuit, the voltage divider configured to increase the stable output voltage of the band gap reference circuit.

17. An electrical circuit as recited in claim 11, further comprising transistor components configured to increase an output current of the band gap reference circuit, the transistor components including a field-effect transistor coupled to the folded cascode feedback circuit and a bipolar junction transistor coupled to the field-effect transistor and to the band gap reference circuit.

18. An electrical circuit as recited in claim 11, further comprising a capacitor configured to prevent a positive feedback potential from being applied to the band gap reference circuit.

19. An electrical circuit as recited in claim 11, further comprising a capacitor coupled to the folded cascode feedback circuit and to the band gap reference circuit, the capacitor configured to prevent a positive feedback potential from being applied to the band gap reference circuit.

20. An electrical circuit as recited in claim 1, further comprising:

a voltage divider configured to increase the stable output voltage of the band gap reference circuit;

transistor components configured to increase an output current of the band gap reference circuit; and a capacitor configured to prevent a positive feedback potential from being applied to the band gap reference circuit.

21. An electrical circuit as recited in claim 11, further comprising:

a voltage divider coupled to the band gap reference circuit, the voltage divider configured to increase the stable output voltage of the band gap reference circuit;

transistor components configured to increase an output current of the band gap reference circuit, the transistor components including a field-effect transistor coupled to the folded cascode feedback circuit and a bipolar junction transistor coupled to the field-effect transistor and to the voltage divider; and a capacitor coupled to the folded cascode feedback circuit and to the field-effect transistor, the capacitor configured to prevent a positive feedback potential from being applied to the band gap reference circuit.

22. A method, comprising:

sensing a current differential with a folded cascode feedback circuit;

generating a feedback potential corresponding to the current differential to stabilize a band gap reference circuit;

applying the feedback potential to a first transistor of the band gap reference circuit, the feedback potential generating a current through the first transistor; and applying the feedback potential to a second transistor of the band gap reference circuit, the feedback potential generating a current through the second transistor, wherein the current through the first transistor is equivalent to the current through the second transistor.

23. A method as recited in claim 22, further comprising inputting a current to a collector of the first transistor, and further comprising inputting a current to a collector of the second transistor.

24. A method as recited in claim 22, further comprising inputting a current to a collector of the first transistor, and wherein applying the feedback potential to the first transistor includes applying the feedback potential to a base of the first transistor.

25. A method as recited in claim 22, further comprising generating a stable output voltage with the band gap reference circuit.

26. A method as recited in claim 22, further comprising generating a stable output voltage with the band gap reference circuit, and increasing the stable output voltage with a voltage divider.

27. A method as recited in claim 22, further comprising increasing an output current of the band gap reference circuit.

28. A method as recited in claim 22, further comprising preventing a positive feedback potential from being applied to the first or second transistors of the band gap reference circuit.

* * * * *